US009417040B2

(12) United States Patent
Redavid, III

(10) Patent No.: US 9,417,040 B2
(45) Date of Patent: Aug. 16, 2016

(54) ARROWHEAD ATTACHMENT

(71) Applicant: Paul John Redavid, III, Lithia Springs, GA (US)

(72) Inventor: Paul John Redavid, III, Lithia Springs, GA (US)

( * ) Notice: Subject to any disclaimer, the term of this patent is extended or adjusted under 35 U.S.C. 154(b) by 0 days.

(21) Appl. No.: 14/704,060

(22) Filed: May 5, 2015

(65) Prior Publication Data

US 2015/0316362 A1 Nov. 5, 2015

Related U.S. Application Data

(60) Provisional application No. 61/988,328, filed on May 5, 2014.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 3,398,960 A * 8/1968 Carroll, Jr. ..... F42B 6/08 473/584
3,604,708 A * 9/1971 Brozina ..... F42B 6/08 473/584
4,254,958 A * 3/1981 Bateman, III ..... F42B 6/08 473/583
4,405,133 A * 9/1983 Cartwright, Jr. ..... F42B 6/08 473/582
5,143,380 A * 9/1992 Maleski ..... F42B 6/08 473/584
6,319,161 B1 * 11/2001 Martinez ..... F42B 6/08 473/583
7,374,505 B2 * 5/2008 Polando ..... F42B 6/08 473/584
8,162,784 B1 * 4/2012 Bellefeuille ..... F41B 3/02 124/20.3
8,663,041 B1 * 3/2014 Gryspeerd ..... F42B 6/08 473/582
8,668,606 B1 * 3/2014 Gryspeerd ..... F42B 6/08 473/582

* cited by examiner

*Primary Examiner* — John Ricci
(74) *Attorney, Agent, or Firm* — Dunlap Bennett & Ludwig PLLC

(57) ABSTRACT

An arrowhead attachment is provided. The arrowhead attachment may be formed from a unitary sheet of attachment material so as to be bent and/or twisted from a shipping configuration to an operable configuration. The arrowhead attachment may include an annular body and a plurality of radial arms extending from a periphery of the annular body. In the shipping configuration, at least one piercing tip is disposed alone each radial arm so as to be co-planar with the plurality of radial arms and the annular body. A user may use a common tool to twist the arrowhead attachment from the shipping configuration to the operable configuration. Then the user may place the arrow shaft through a shaft opening formed by the annular body so as to couple the arrowhead attachment behind an arrowhead.

14 Claims, 4 Drawing Sheets

ARROWHEAD ATTACHMENT

CROSS-REFERENCE TO RELATED APPLICATION

This application claims the benefit of priority of U.S. provisional application No. 61/988,328, filed 5 May 2014, the contents of which are herein incorporated by reference.

BACKGROUND OF THE INVENTION

The present invention relates to bow hunting accessories and, more particularly, to an attachment for arrowheads to aid in the recovery of game animals and the arrow used.

Few large animals can be dropped immediately by an arrow, and a relatively low percentage of game animals hit by a conventional broad head arrows are recovered by the hunter.

Current devices for increasing the effectiveness of an arrowhead have multiple elements, which increase their cost, especially considering that they can only be used once.

As can be seen, there is a need for an inexpensive device of unitary construction for cost effectively increasing the effective cutting diameter of an arrow used to bring down game animals.

SUMMARY OF THE INVENTION

In one aspect of the present invention, an arrowhead attachment formed from an unitary, planar sheet of attachment material includes an annular body forming a shaft opening; a plurality of radial arms extending radially from a periphery of the annular body; and at least one piercing tip disposed along each radial arm, whereby each piercing tip, each radial arm and the annular body are planar in a shipping configuration.

In another aspect of the present invention, the attachment material is adapted to maintain a twisted form when the shipping configuration is positioned to an operable form.

These and other features, aspects and advantages of the present invention will become better understood with reference to the following drawings, description and claims.

DETAILED DESCRIPTION OF THE INVENTION

Figure 1:
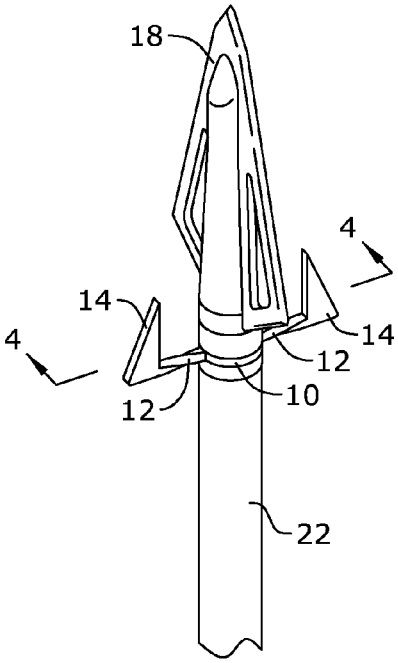
FIG. 1 is a perspective view of an exemplary embodiment of the present invention, shown in use.
Figure 2:
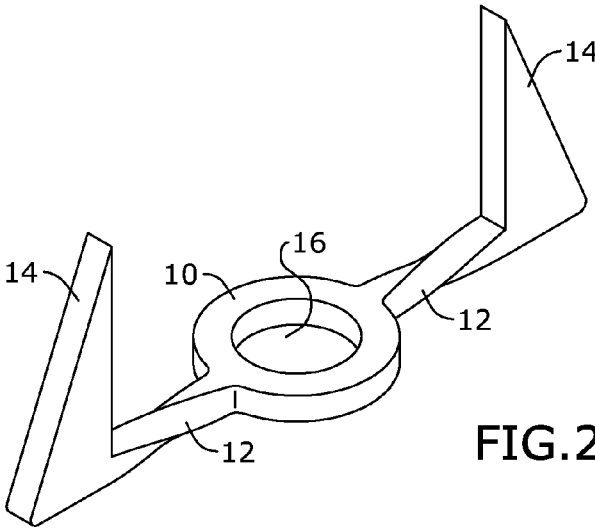
FIG. 2 is a perspective view of an exemplary embodiment of the present invention, shown in an operable configuration.

The following detailed description is of the best currently contemplated modes of carrying out exemplary embodiments of the invention. The description is not to be taken in a limiting sense, but is made merely for the purpose of illustrating the general principles of the present invention.

Broadly, an embodiment of the present invention provides an arrowhead attachment. The arrowhead attachment may be formed from a unitary sheet of attachment material so as to be bent and/or twisted from a shipping configuration to an operable configuration. The arrowhead attachment may include an annular body and a plurality of radial arms extending from a periphery of the annular body. In the shipping configuration, at least one piercing tip is disposed alone each radial arm so as to be co-planar with the plurality of radial arms and the annular body. A user may use a common tool to twist the arrowhead attachment from the shipping configuration to the operable configuration. Then the user may place the arrow shaft through a shaft opening formed by the annular body so as to couple the arrowhead attachment behind an arrowhead.

Referring now to FIGS. 1 through 12, the present invention may include an arrowhead attachment 100. The arrowhead attachment 100 may be made from a planar sheet of attachment material so as to be formed into a shipping configuration, illustrated in FIGS. 5 and 7. The attachment material can be bent and/or remain twisted without fracturing and still have sufficient strength to prevent shattering on impact on the intended use disclosed herein. The attachment material may be tempered steel and the like. The arrowhead attachment 100 may be dimensioned and adapted to be bent and/or twisted from the shipping configuration to the operable configuration; the operable configuration is illustrated in FIGS. 2, 6, 8 through 11.

The arrowhead attachment 100 may form an annular body 10 and a plurality of radial arms 12 extending from a periphery of the annular body 10. The annular body 12 may form a shaft opening 16. The shaft opening 16 may be dimensioned and adapted to receive a post 20 of an arrowhead 18 and/or a shaft 22 of an arrow so that the arrowhead attachment 100 may be coupled or otherwise attached thereto. At least one piercing tip 14, 26, 28, 30, 32 or 34 may be disposed along each radial arm 12. In the shipping configuration, the at least one piercing tip 14, 26, 28, 30, 32 or 34 may disposed alone each radial arm so as to be co-planar with the plurality of radial arms 12 and the annular body 10. In other words, the shipping configuration is planar throughout its form, and so enabling flat packing, ease of manufacture through punch-out, or the like, manufacturing.

Figure 9:
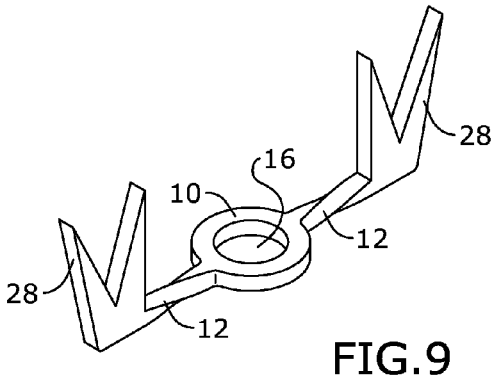
FIG. 9 is a perspective view of an exemplary embodiment of the present invention, shown in the operable configuration.
Figure 10:
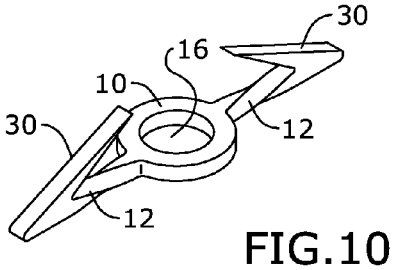
FIG. 10 is a perspective view of an exemplary embodiment of the present invention, shown in the operable configuration.
Figure 11:
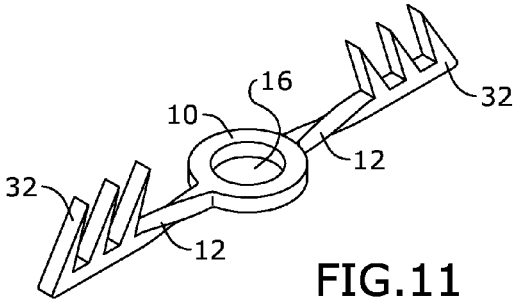
FIG. 11 is a perspective view of an exemplary embodiment of the present invention, shown in the operable configuration.
Figure 12:
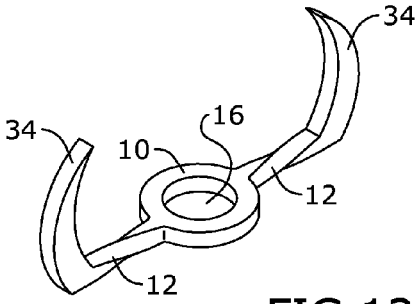
FIG. 12 is a perspective view of an exemplary embodiment of the present invention, shown in the operable configuration.

Each piercing tip 14, 26, 28, 30, 32 or 34 may be the most significant penetrating element, so that its shape is of some significance. The shape of each piercing tip 14, 26, 28, 30, 32 or 34 may be generally triangular and oriented as illustrated in FIGS. 5 through 12. Each piercing tip 14, 26, 28, 30, 32 or 34 may be shaped, dimensioned and adapted to provide maximum penetration and effective ripping and tearing with adequate strength but minimum weight. In certain embodiments, the piercing tip 34 may be half-crescent shaped, as illustrated in FIG. 12. In certain embodiments, the piercing tip 28 may be beak-shaped, as illustrated in FIG. 9.

The operable configuration is illustrated in FIGS. 2, 6, 8 through 11 and may be accomplished by the following. Each radial arm 12 may be twisted approximately 90 degrees so that each piercing tip 14, 26, 28, 30, 32, or 34 disposed thereon may face generally perpendicular to the plane to the annular body 10, and so each piercing tip 14, 26, 28, 30, 32, or 34 may generally face the direction of the arrowhead 18. The operable configuration is adapted to expand the cutting diameter and so the effectiveness of the arrowhead 18. The expanded cutting diameter may increase the probability of immediate kill of a game animal and generation of a sufficient blood trail from external bleeding to allow tracking and recovering of the game animal. Likewise, the operable configuration may be adapted to maximize traumatic damage to the game animal by ripping and tearing vital organs as well as minimize the likelihood that the wound closes quickly.

From the description above, a number of advantages of some of the embodiments become evident. For example, the planar arrowhead attachment 100 can be manufacture in a cost effective manner, whereby a single sheet of attachment metal may be used to punch out or cut out a plurality of arrowhead attachments 100. The immediate result of such a process is the shipping configuration, thereby lending itself to flat packing so as to make shipping to a user very inexpensive.

Figure 3:
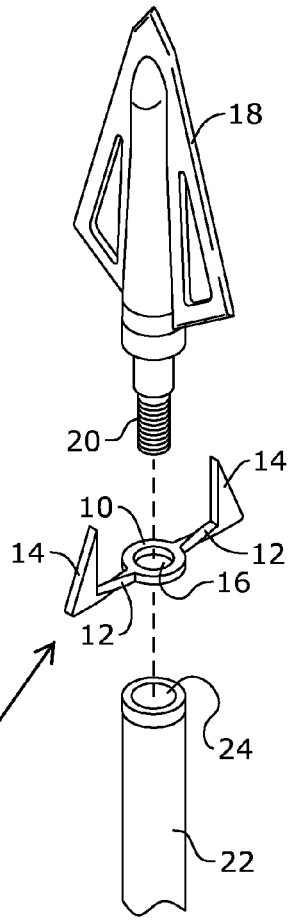
FIG. 3 is an exploded view of an exemplary embodiment of the present invention, shown in use.
Figure 4:
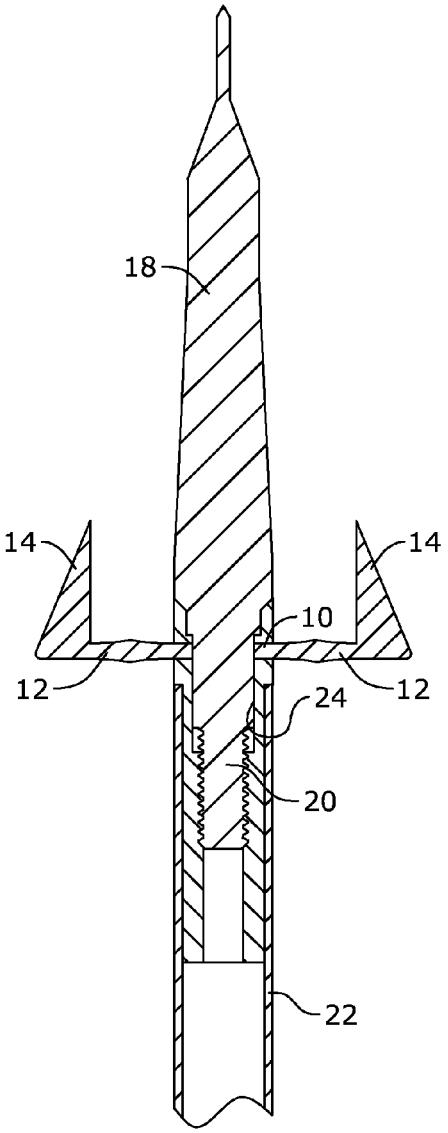
FIG. 4 is a section view of an exemplary embodiment of the present invention, taken along line 4-4 in FIG. 1.
Figure 5:
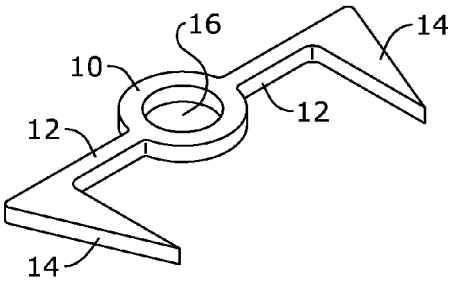
FIG. 5 is a perspective view of an exemplary embodiment of the present invention, shown in a shipping configuration.
Figure 6:
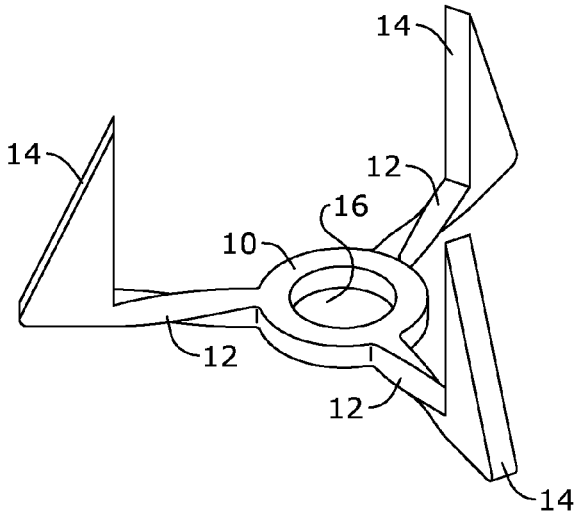
FIG. 6 is a perspective view of an exemplary embodiment of the present invention, shown in the operable configuration.
Figure 7:
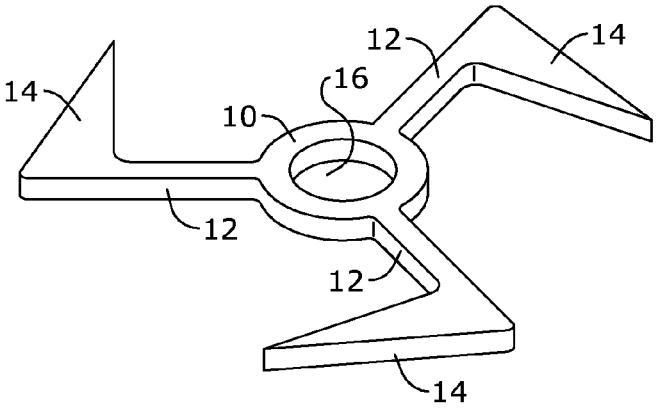
FIG. 7 is a perspective view of an exemplary embodiment of the present invention, shown in the shipping configuration.
Figure 8:
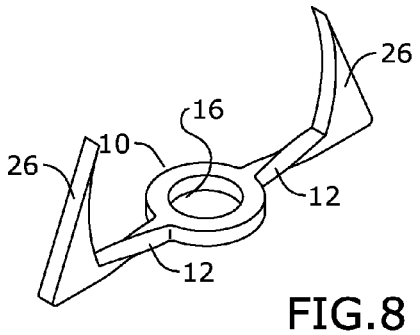
FIG. 8 is a perspective view of an exemplary embodiment of the present invention, shown in the operable configuration.

The method of using the present invention may include the following. The arrowhead attachment 100 disclosed above may be provided. A user may use a common tool, such as pliers, to twist the arrowhead attachment 100 from the shipping configuration to the operable configuration. Then the user may place the arrow shaft 22 through the shaft opening 16 of the annular body 10 so as to couple the arrowhead attachment 100 behind the arrowhead 18, as illustrated in FIGS. 1 and 4. In certain embodiments, the post 20 of the arrowhead 18 may be received through the shaft opening 16 prior to securely engaging a shaft slot 24, and so coupling the arrowhead attachment 100 behind the arrowhead 18, as illustrated in FIG. 3. As a result increasing the effective cutting diameter of the arrowhead 18, whereby the probability of an immediate kill of a game animal as well as its external bleeding correspondingly increases, and so that tracking and recovering of the game animal in turn increases.

It should be understood, of course, that the foregoing relates to exemplary embodiments of the invention and that modifications may be made without departing from the spirit and scope of the present invention.

What is claimed is:

1. An arrowhead attachment formed from an unitary, planar sheet of attachment material, comprising:

an annular body forming a shaft opening;

a plurality of radial arms extending radially from a periphery of the annular body; and at least one piercing tip disposed along each radial arm, wherein each piercing tip, each radial arm and the annular body are planar in a shipping configuration.

2. The arrowhead attachment of claim 1, wherein the attachment material is adapted to maintain a twisted form when the shipping configuration is positioned to an operable configuration.

3. The arrowhead attachment of claim 1, wherein each piercing tip is generally triangular.

4. The arrowhead attachment of claim 1, wherein each piercing tip is half-crescent shaped.

5. The arrowhead attachment of claim 1, wherein each piercing tip is beak-shaped.

6. A method of increasing the effective cutting of an arrowhead using a arrowhead attachment of claim [[6]] 1, comprising:

twisting each radial arm so that the arrowhead attachment is in the operable configuration; and connecting the arrowhead and an arrow shaft so that the arrowhead and the arrow shaft sandwich a portion of the annular ring, wherein the arrowhead attachment is positioned behind the arrowhead, and wherein each piercing tip is planar with the arrowhead.

7. The method of claim 6, wherein at least one piercing tip is generally triangular.

8. The method of claim 6, wherein at least one piercing tip is half-crescent shaped.

9. The method of claim 6, wherein at least one piercing tip is beak-shaped.

10. A method of manufacturing low cost and easy to ship arrowhead attachments, comprising:

providing a unitary sheet of attachment material;

punching out a plurality of arrowhead attachment forms, each comprising:

an annular body forming a shaft opening;

a plurality of radial arms extending radially from a periphery of the annular body; and at least one piercing tip disposed along each radial arm, wherein each piercing tip, each radial arm and the annular body are planar in a shipping configuration; and flat packing, shipping and selling the plurality of arrowhead attachment forms, wherein at least one end-user only twists each radial arm to form an operable configuration.

11. The method of claim 10, wherein at least one piercing tip is generally triangular.

12. The method of claim 10, wherein at least one piercing tip is half-crescent shaped.

13. The method of claim 10, wherein at least one piercing tip is beak-shaped.

14. An arrowhead attachment formed from an unitary, planar sheet of attachment material, comprising:

an annular body forming a shaft opening;

a plurality of radial arms extending radially from a periphery of the annular body; and at least one piercing tip disposed along each radial arm, wherein each piercing tip is generally triangular, and wherein each piercing tip, each radial arm and the annular body are planar in a shipping configuration.

* * * * *